United States Patent [19]

Leeper

[11] 4,080,971

[45] Mar. 28, 1978

[54] BATTERY POWERED FOOT WARMING INSOLE

[76] Inventor: Rory Ann Leeper, 2735 Copley Ave., San Diego, Calif. 92116

[21] Appl. No.: 710,192

[22] Filed: Jul. 30, 1976

[51] Int. Cl.[2] ..... A61N 5/00

[52] U.S. Cl. ..... 128/383

[58] Field of Search ..... 128/382, 383, 399, 402; 219/211

[56] References Cited

U.S. PATENT DOCUMENTS

| | | | |
|---|---|---|---|
| 1,275,451 | 8/1918 | Lillard | 128/382 |
| 1,288,045 | 12/1918 | Kuhn et al. | 128/382 |
| 2,633,846 | 4/1953 | Wray | 128/402 |
| 2,692,326 | 10/1954 | Crowell | 219/19 |
| 2,712,591 | 7/1955 | Rogell | 128/402 UX |
| 3,293,405 | 12/1966 | Costanzo | 219/211 |
| 3,360,633 | 12/1967 | Weisberger | 219/211 |
| 3,392,264 | 7/1968 | Arron | 128/382 |
| 3,534,391 | 10/1970 | Bauer | 219/211 |
| 3,621,191 | 11/1971 | Cornwell | 219/211 |
| 3,663,796 | 5/1972 | Hines et al. | 219/211 |
| 3,859,496 | 1/1975 | Giese | 128/383 |
| 3,906,185 | 9/1975 | Gross et al. | 128/383 |
| 3,946,193 | 3/1976 | Giese | 128/383 |

*Primary Examiner*—Lawrence W. Trapp
*Attorney, Agent, or Firm*—Brown & Martin

[57] ABSTRACT

A strip of electrical resistance heating element is sandwiched between plastic foam insulative layers of an insole. Wires connect between the ends of the heating element and a battery pack. The wires are lead along the edge of the insole and exit the insole rearwardly of the nominal position for the user's ankle bone. The battery pack incorporates two hinged shell halves for completely enclosing a battery. A strap holds the two shells halves together and secures the battery pack over the calf area of the user's leg. A contact connects the negative terminal of the battery to one wire. The other wire is connected to a switch terminal. A switch blade is pivoted on the positive terminal electrical contact from the positive terminal of the battery. In the on position, the switch blade connects between the positive terminal of the battery and the electrical terminal for the other of the connecting wires.

7 Claims, 6 Drawing Figures

BATTERY POWERED FOOT WARMING INSOLE

BACKGROUND OF THE INVENTION

It has been long recognized that the foot is the most difficult area to maintain sufficiently warm for comfort. Because the foot is an extremity, blood flow to this area is less effective in maintaining warmth. Maintaining the warmth of the foot area is especially difficult when special purpose footwear, such as ski boots are utilized. Ski boots have been developed to a high level of performance in transferring the wearer's motions to the skis and in minimizing the possibility of injury. Performance and safety considerations however are not necessarily compatible with good insulative qualities. Similar considerations apply to other footwear such as hiking boots. The problems of maintaining warmth on the foot are most difficult during periods of inactivity.

In recognition of the impracticality in maintaining foot warmth solely through insulative means, the prior art has developed a variety of electrically powered foot warmers. In a typical device, the electrical foot warmer consists of an electrical resistance heating element built into the shoe or boot or incorporated into a special purpose sock. Electrical energy is provided by a battery clipped to the boot or to the user's belt for example. Such devices have not seen wide spread application due to several independent deficiencies. Frequently such devices result in an impractical short battery life resulting from the lack of a practical switch, excessive current drain, or exposure of the battery to the elements. Other such devices have been uncomfortable to wear because the electrical heating elements is of a size and shape that irritates the ball of the user's foot. Still another problem with such devices is that the heat generated by the electrical resistance element is not positioned for maximum benefit and alternatively the positioning and configuration of the heating element results in uncomfortable hot spots.

Therefore, it is desirable to have a battery powered foot warmer that extends battery life and provides controlled and selective application of heat. Such a device is particularly valuable where the device may be installed in a variety of footwear and used without any uncomfortable pressure points on the wearer's foot.

SUMMARY OF THE INVENTION

An exemplary embodiment of the invention overcomes the deficiencies of prior art foot warmers in a device incorporating a flexible insole that may be inserted into any suitable footwear, including ski boots, hiking boots and the like. An electrical heating element is provided in the form of a flat nichrome strip following a tortuous path concentrated in the toe portion of the insole. The relatively lengthly resistance strip reduces battery drain and produces a gentle warmth that is evenly distributed over the toe area. Since the toe area is most sensitive to cold, this produces maximum overall benefit for a given battery usage. The heat conducted to the remainder of the foot is sufficient to prevent the remainder of the foot from becoming cold without wasting electrical energy. The flexible insole is of a foamed plastic insulative material.

The nichrome strip is formed in the tortuous path extending from left to right across the toe area of the boot and then having a front to back strip to complete the circuit. Thus, the entire heating element under the ball of the wearer's foot is essentially flat and cannot apply pressure or otherwise create an uncomfortable sensation on the ball of the foot. Electrical connections are made under the foot instep so that no pressure point is created there. Connecting wires are lead from the ends of the nichrome strip to the edge of the insole pad, then along the pad to exit the pad rearwardly of the point at which the user's ankle bone is nominally positioned. Thus, the wires may be drawn out of a ski boot or the like without creating any uncomfortable sensation on the user's ankle. The insulative material causes additional spreading of the heat and increases the effectiveness of the heat by reducing the heat loss through the bottom of the footwear.

The battery and electrical connections are housed in a battery case consisting of two plastic shell halves hinged together by a solid hinge. The hinging of the shell halves makes it possible to easily remove and replace the battery. The assembled integrity of the device is assured by passing a leg strap through the free ends of the shell halves so that the leg strap serves both as a closure for the battery case and as a means of safely attaching the battery case to the user's leg. The battery case and strap are normally fastened around the user's leg above the calf area for maximum comfort and to minimize the exposure of the battery to the outside environment. Thus, the battery case together with the positioning of the user's leg, maintains a relatively high battery temperature and therefore produces a full battery electrical output.

A heater for each foot is individually powered by a separate battery. A first wire is permanently electrically connected to the negative terminal of a battery in the battery case. The second wire is connected to a terminal which may be switchably connected to the positive terminal of the battery. The electrical connection to the positive terminal of the battery consists of a grommet on the case which also serves as a pivot point for an electrical switch blade. The switch blade may be pivoted between off and on positions. In theon position, the switch blade cooperates with the terminal for the second wire to complete the electrical circuit. The switch blade includes a detent which is received in the opening on the electrical terminal to resiliently hold the switch blade in the on position.

The apparatus of the invention, while relatively simple, easy to manufacture, and low in cost, nevertheless provides an electrically powered foot warmer which produces a desirable, gentle and controlled heat at the most cold sensitive areas of a wearer's foot, while at the same time not introducing other discomforters such as pressure on the ball of the user's foot, irritation from the wires exiting the footwear, or irritation from the positioning or attachment of the battery pack to the user.

Other advantages of the invention will become more apparent upon a reading of the following detailed description together with the drawings in which like reference numerals refer to like parts throughout and in which:

DETAILED DESCRIPTION OF THE DRAWINGS

Figure 1:
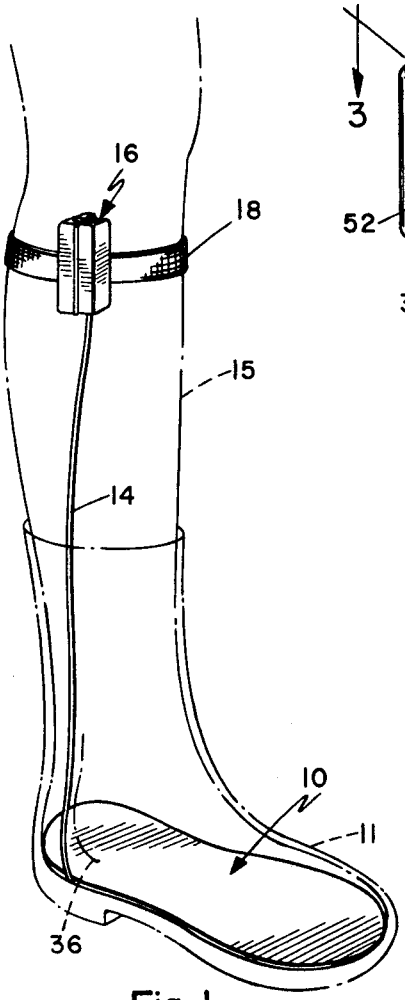
FIG. 1 illustrates the apparatus in use.

Referring now to the drawings, there is illustrated an insole pad 10 received within a boot indicated generally at 11. The insole includes an electrical heating element 12. Connecting wires 14 extend between the insole 10 and a battery pack 16. The battery pack is carried on the user's leg 15 by the strap 18.

Figure 6:
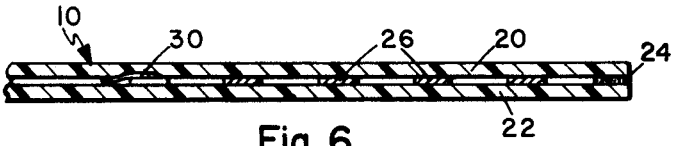
FIG. 6 is an enlarged sectional view taken on line 6—6 of FIG. 5.
Figure 5:
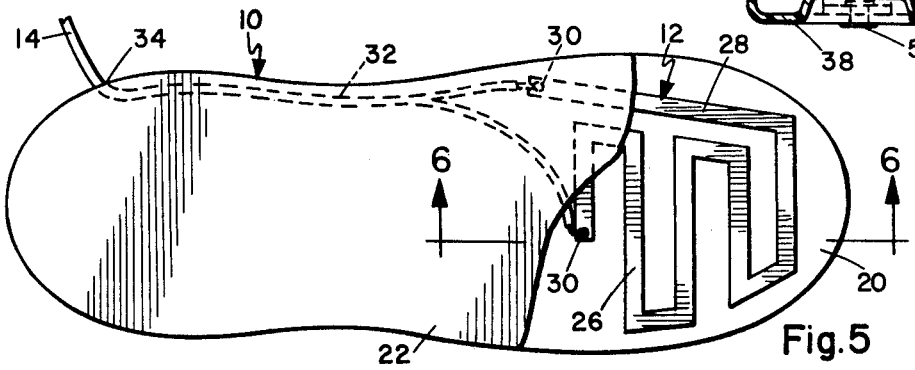
FIG. 5 is a bottom plan view, partially cut away, of the foot pad.

Referring specifically to FIGS. 5 and 6, the detailed construction of the insole 10 is illustrated. Two layers of insulative closed cell plastic foam 20 and 22 are glued together by adhesive layer 24. Any plastic foam having good insulative qualities may be utilized in the practice in the invention. However, the use of polyolithon closed cell foam is particularly advantageous. Polyolithon foam, in addition to having good insulative qualities, and high overall strength, is sufficiently flexible that it may be inserted into a variety of differently shaped footwear and after installation forms a comfortable and compliant surface. The weight of a user's foot compresses the foam to about half of its original thickness (0.32 cm) so that the use of the insole does not substantially change the fit of the footwear. The heating element 12 is sandwiched in between the layers 20 and 22. A flat nichrome strip 26 is made to conform to a tortuous path extending from left to right across the toe area of the insole 10. The segments 26 correspond generally to a plurality of joined U-shaped sections which terminate at the end of the toe section. The pattern is completed by a longitudinal strip 28. The toe portion of the insole is flat with no connections or protuberances. Electrical connections are made well beyond the toe area by spot welds 30 joining the ends of the nichrome strip of the two conductor wire 14. The nichrome strip is approximately 30 cm long, 0.5 cm wide and approximately 0.08 of a millimeter of thickness. It has been found that with this configuration the current drain on a standard 1.5 volt alkaline cell is sufficiently low that the cell will last for approximately 8 hours of continuous use. The heat delivered to the foot is concentrated in the ball and toe area of the foot and is uniformly distributed over that area by the upper insulative layer 20. The insulative layer functions to distribute the heat so that the top surface of the layer 20 never exceeds approximately 105° F (40° Celsius).

The two conductor wire 40 is lead from the spot welding connections 30 to the side of the insole at 32 to avoid any discomfort under the heel area. The wire 14 exits the insole at point 34 which is rearwardly of the nominal position of the ankle bone. The relationship of the wire 14 to the ankle bone is illustrated in FIG. 1 which illustrates the wire 14 passing behind the ankle bone 36 and out of the top of the boot 11.

Figure 2:
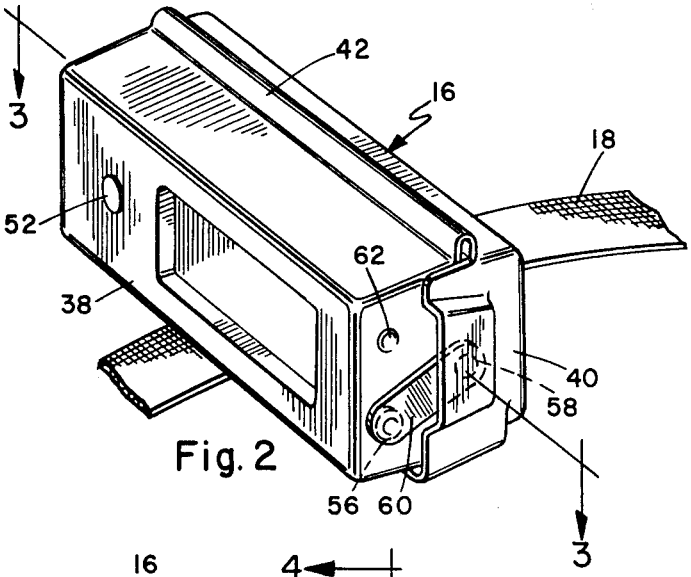
FIG. 2 is a perspective view of the battery pack.
Figure 3:
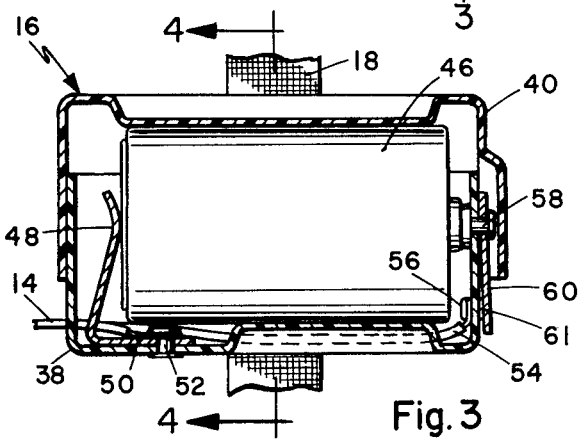
FIG. 3 is a sectional view taken on line 3—3 of FIG. 2.
Figure 4:
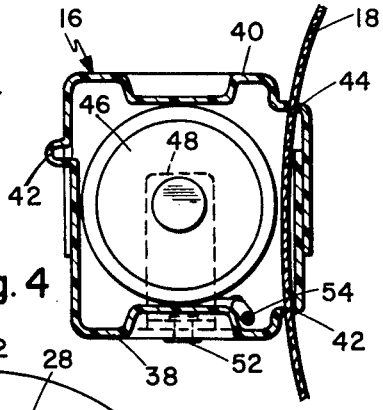
FIG. 4 is a sectional view taken on line 4—4 of FIG. 3.

The detailed construction of the battery case 16 is illustrated in FIGS. 2 through 4. Two shell halves 38 and 40 are joined together by a solid hinge 42. Shell 40 overlies the perimeter of the shell 38 so as to form a complete enclosure for battery 46. It will be apparent that the shell halves may be pivoted around the solid hinge 42 to open the case for insertion of a battery 46. When closed, the strap 18 is passed through openings 42 and 44 in the shall halves 38 and 40 respectively to form a secure enclosure for the case as well as to attach the case to the strap 18.

A first conductor 50 from the wire 14 is secured together with a spring battery connector 48 by a rivet 52. Thus, the rivet 52 provides both the electrical connection between the conductor 50 and spring clip 48 and secures both parts to the case half 38. The spring clip is permanently in contact with the negative terminal of battery 46. The second conductor 54 is secured to the case half 38 by a rivet terminal 56. Electrical connection between the positive terminal of the battery and the terminal 56 is made through a rivet 58 and switch blade 60. Rivet 58 is positioned to contact the positive terminal of battery 46 and also carries the switch blade 60 for pivotal movement. When the switch blade 60 is pivoted into contact with the terminal 56, a detent 61 is received in the opening in the terminal 56 which frictionally and resiliently holds the switch blade 60 in contact with the terminal 56, thereby completing and maintaining electrical connection between the battery and heating element 12. When it is desired to interrupt the electrical current, the switch blade 60 is pivoted so that the detent 61 engages the recess 62 on the shell half 38. The recess 62 is not electrically connected to the battery 46 thereby providing a secure off position for the device.

It will be noted from FIG. 1 that the device is secured above the calf portion of the user so that the case and battery are well protected by the user's clothing from the elements. The position is also desirable from the standpoint of user comfort. This is a portion of the user's anatomy that is relatively infrequently contact by the user's movements even in active sports, such as skiing. Should the user fall or otherwise strike the battery case, the case is free to move about the user's leg on the strap 18. Thus, excessive forces will not be transferred to the battery case or to the user's leg, minimizing the chance of injury to either.

Having described my invention, I now claim:

1. A battery powered foot warmer for use in conventional shoes and boots to provide controlled, diffused heating to selected areas of the foot, comprising:

an elongated strip of resistance heating element, an insole pad, said insole pad being comprised of at least two layers of plastic foam insulative material, said resistance heating element being secured between layers of said plastic foam insulative material to said pad in the toe area thereof, a battery pack for housing a battery and for making electrical connections to said battery, interconnecting wires for completing an electrical circuit from said battery pack to said resistance heating element.

2. The battery powered foot warmer according to claim 1 wherein: said plastic foam insulative foam comprises polyolithon foam having a density of approximately 16 kilogram per cubic meter.

3. The battery powered foot warmer according to claim 2 wherein: said layers of plastic foam are approximately 0.3 cm in thickness.

4. A battery powered foot warmer for use in conventional shoes and boots to provide controlled, diffused heating to selected areas of the foot, comprising:

an elongated strip of resistance heating element, an insole pad, said resistance heating element being secured to said pad in the toe area thereof, a battery pack for housing a battery and for making electrical connections to said battery, interconnecting wires for completing an electrical circuit from said battery pack to said resistance heating element, said battery pack incorporating two shell halves for completely enclosing said battery, a strap passing through the said shell halves and adapted to be secured around the user's leg.

5. The battery powered foot warmer according to claim 4 including:

electrical contacts in said battery pack for making electrical contact with the positive and negative terminals of said battery, a switch blade pivotally mounted on said positive electrical contact for pivotal movement between on and off positions, said on position of said switch blade connecting an electrical terminal for one of said wires connecting between said battery pack and said heating element.

6. The battery powered foot warmer according to claim 5 wherein: said switch blade having a detent for cooperating with said electrical contact to resiliently hold said switch blade in the on position.

7. A battery powered foot warmer for use in conventional shoes and boots to provide controlled, diffused heating to selected areas of the foot, comprising:

an elongated strip of resistance heating element, an insole pad, said resistance heating element being secured to said pad in the toe area thereof, a battery pack for housing a battery and for making electrical connections to said battery, interconnecting wires for completing an electrical circuit from said battery pack to said resistance heating element, said interconnecting wires being led to the side of said pad from the point of connection to the said resistance strip and exiting said pad at a position immediately rearwardly to the nominal position of a user's ankle bone.

* * * * *